United States Patent [19]

Wang

[11] Patent Number: 4,571,204

[45] Date of Patent: Feb. 18, 1986

[54] STUNT TOY DEVICE

[76] Inventor: Ta-Lung Wang, 1st Fl., No. 27, La. 432, Wu-hsing St., Taipei, Taiwan

[21] Appl. No.: 579,072

[22] Filed: Feb. 10, 1984

[51] Int. Cl.[4] ..... A63H 33/26

[52] U.S. Cl. ..... 446/138; 446/236; 446/445

[58] Field of Search ..... 446/129, 137, 138, 132, 446/136, 444–447, 454, 455, 462, 236

[56] References Cited

U.S. PATENT DOCUMENTS

| | | | |
|---|---|---|---|
| 4,031,660 | 6/1977 | Chen | 446/132 X |
| 4,386,777 | 6/1983 | Prehodka | 446/444 X |
| 4,468,031 | 8/1984 | Barlow et al. | 446/138 X |

*Primary Examiner*—Mickey Yu

*Attorney, Agent, or Firm*—Cushman, Darby & Cushman

[57] ABSTRACT

A ring type stunt toy device including a ring structure, two fixing blocks, a base and a wheeled toy wherein the ring structure has two metal rings which can be attracted by magnet at its inner circumference, two supports at its external circumference with column projections to insert into the recessions of the column member ends of the fixing blocks respectively so that the ring structure can rotate between the supports and the wheeled toy has a wheel like covers with a wheelbase slightly wider than the width of the ring structure so that it can be placed across the ring structure and while the right and left conductive wheels are contacting the metal rings, the motor in the wheeled toy rotate and drive the wheeled toy for forward movement and due to the weight of the wheeled toy, the ring structure rotate simultaneously.

3 Claims, 9 Drawing Figures

STUNT TOY DEVICE

BACKGROUND OF THE INVENTION

The invention relates to a stunt toy device and particularly to a ring type wheeled toy.

The conventional wheeled toys now available in the market mostly have their own built-in power source and are mainly of self-moving, or by the gravity in high potential and low potential for a ball structure to slide around a ring structure, or for an object to travel around a certain cycle. Though there has been a lot of choice, it is too simple in view of the function of toy. All of the above types of toys move within a plane. None of such toy types can satisfy the requirements of todays's advanced three-dimensional games. Furthermore, a wheeled toy having a built-in power source must have a set of batteries within it in order to drive a motor for rotation of wheels. Thus, the weight of a wheeled toy is increased and the load for transmission is increased accordingly which, on the other hand, accelerates the consumption of battery.

SUMMARY OF THE INVENTION

The invention provides a stunt toy device, particularly a ring type wheeled toy comprising mainly a ring structure and a wheeled toy. For operation of the toy, a battery is first loaded within a base beneath the ring structure. The power is then turned on so that a circuit is formed via the supports and the fixing blocks outside the ring structure towards the inner metal rings in the ring structure. The right and left conductive wheels of the wheeled toy contact the said inner metal rings. Thus, the small motor in the wheeled toy is driven and the four conductive wheels of the wheeled toy are driven to rotate for forward movement. Moreover, the four conductive wheels of the wheeled toy are attached with magnetic elements respectively so that they can be attracted by the metal plates made of iron in order to prevent the wheeled toy from falling down from the ring structure. During operation, the forward movement of the wheeled toy coupled with the forces of gravity acting on the toy cause the ring structure to rotate around its base.

DETAILED DESCRIPTION

Figure 1:
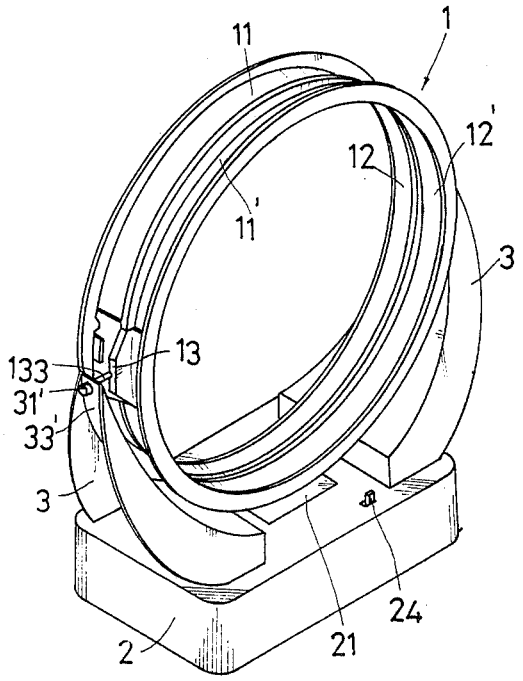
FIG. 1 is a perspective view of a preferred embodiment of the present invention.
Figure 2:
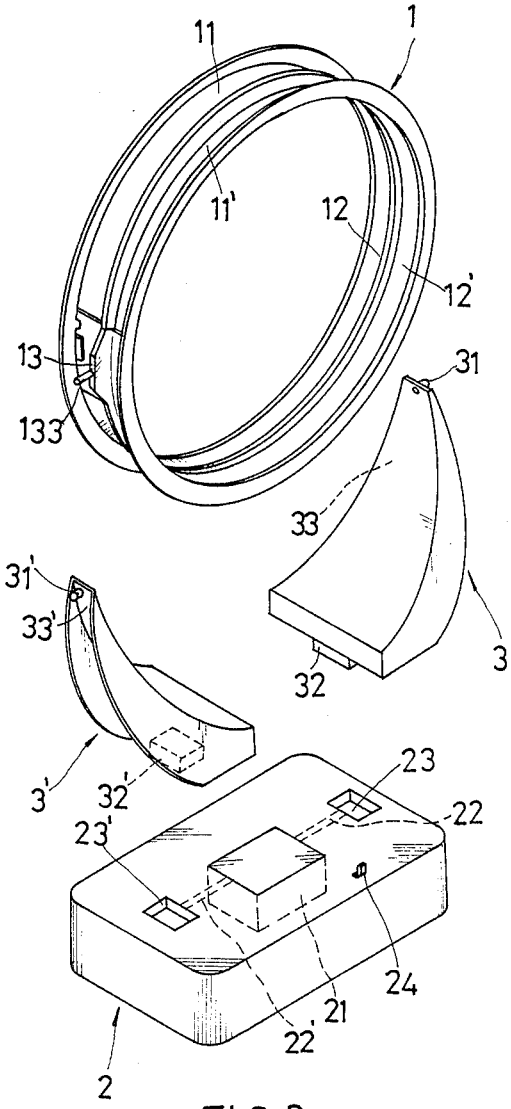
FIG. 2 is an exploded perspective view of a preferred embodiment of the present invention.

A detailed description of a preferred embodiment of the present invention is given with reference to the attached drawings as follows:

FIG. 1 is a perspective view of a preferred embodiment of the present invention while the FIG. 2 is an exploded perspective view of the preferred embodiment. The preferred embodiment has a ring structure 1 and a base 2 beneath it. They are fixed together by two fixing blocks 3 and 3' between them. The external circumference of the ring structure 1 is composed of two rails 11 and 11' and its internal circumference has two corresponding metal rings 12 and 12' made of iron.

Figure 3:
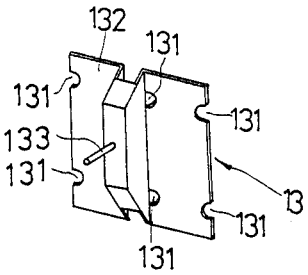
FIG. 3 is a presepective view of the support of a preferred embodiment of the present invention.

The metal rings 12 and 12' do not touch with each other. Each of the right side and left side of the external circumference of the ring structure 1 at the position in touch with the fixing blocks 3 and 3' respectively has a support 13 (please refer to the FIG. 3) which is fixed to the ring structure 1 in a manner that each support 13 has four holes 131 at its foot subject to the suppression of four projections from positions corresponding to the inner metal rings 12 and 12' respectively so that the support 13 is fixed to the ring structure 1. Each of the support 13 has a foot insulated from the metal ring 12 or 12' by an insulation plate 132 so that the metal rings 12 and 12' and only a support 13 are conductive to each other. There is a battery set 21 in the base 2. The poles of the battery set 21 are extended outwards by two metal plates 22 and 22'. At each side of the base there is a receiving opening 23 or 23' for fixing the ends 32 or 32' of the fixing block 3 or 3'. The front end of the fixing block 3 or 3' has a column member 31 or 31' with recession for the insertion of the column projection 133 of the support 13 so that the ring structure 1 is rotatable at the support 13 between the fixing blocks 3 and 3'. The fixing blocks 3 and 3' are hollow wherein a metal plate 33 or 33' is installed respectively so that the fixing blocks 3 and 3' are positioned between the base 2 and the ring structure 1, the said metal plates keep contact with the metal plates 12 and 12' as well as the column projection 133 of the support 13 respectively to form a conductive circuit.

Figure 4:
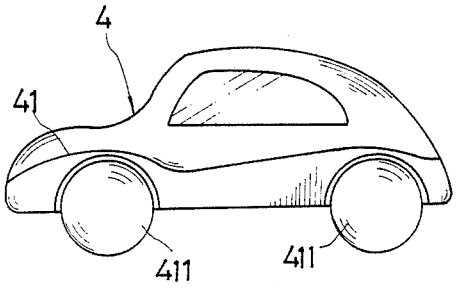
FIG. 4 is a side view of a wheeled toy car, a preferred embodiment of the present invention.
Figure 5:
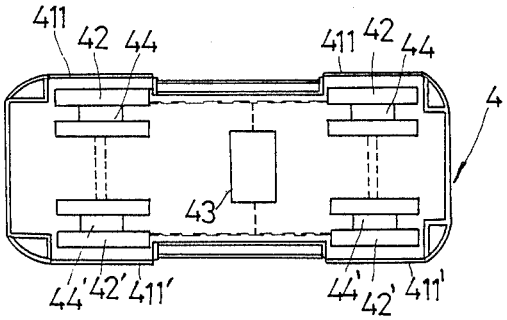
FIG. 5 illustrates the bottom of a wheeled toy car, a preferred embodiment of the present invention.

Please refer to the FIG. 4 and FIG. 5. A wheeled toy car 4 for the device is composed of a car body 41 and four metal wheels 42 and 42'. The car body 41 has four integrated wheel covers 411 and 411' at its bottom with a wheelbase just equal to the width of the ring structure 1 so that the car body 41 can be placed across the ring structure 1 and the car body 41 will not move transversely on the ring structure 1. At the inner side of each of the integrated wheel covers 411 or 411' of the car body 41 there is a metal wheel 42 or 42' respectively. Please refer to the FIG. 5. Each pair of the front wheels and rear wheels are fixed by a shaft. The metal wheel 42 is in touch with the metal ring 12, while the metal wheels 42' is in touch of the metal ring 12'. At the center of the car body 41 there is a small motor 43 with wiring at its positive and negative poles to connect the metal wheels 42 and 42' contacting the metal rings 12 and 12' at its right and left side respectively. Therefore, a circuit is formed from the positive pole of the battery set 21 via the fixing block 3, the support 13, the metal ring 12, the metal wheels 42, the motor 43 and another set of metal wheels 42', metal rings 12', support 13 and fixing block 3' to the negative pole of the battery set 21. The power is turned on, the motor 43 rotates and drives the metal wheels for rotation and forward movement. The metal wheels 42 and 42' are installed with magnetic elements 44 and 44' so that the wheeled car 4 will not fall down from the ring structure 1 while the four magnetic elements 44 and 44' are not touching the metal rings 12 and 12' but attracting the two metal rings 12 and 12'.

Figure 9:
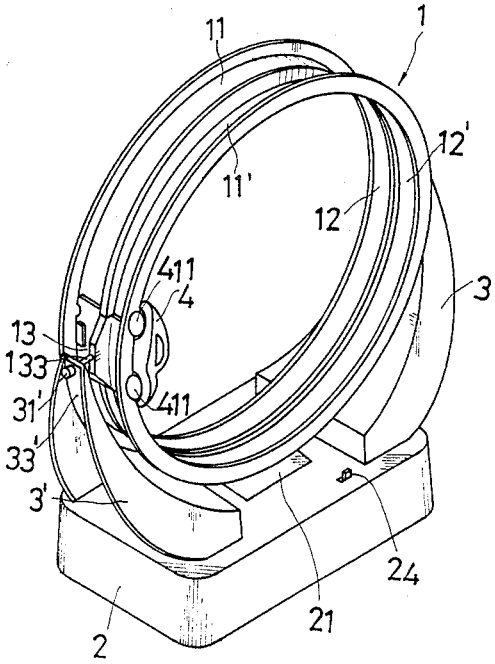
FIG. 9 illustrates a performance 4 of a preferred embodiment of the present invention wherein the wheeled toy car has moved forward relative to performance 3 and the ring structure is tilted perpendicular to the base.
Figure 7:
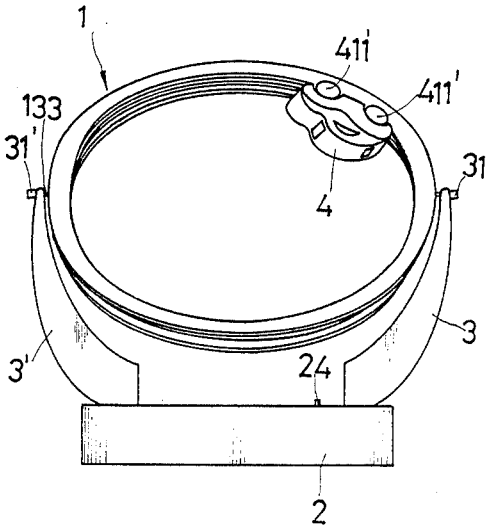
FIG. 7 illustrates a performance 2 of a preferred embodiment of the present invention wherein the wheeled toy car has moved upwardly relative to performance 1.
Figure 8:
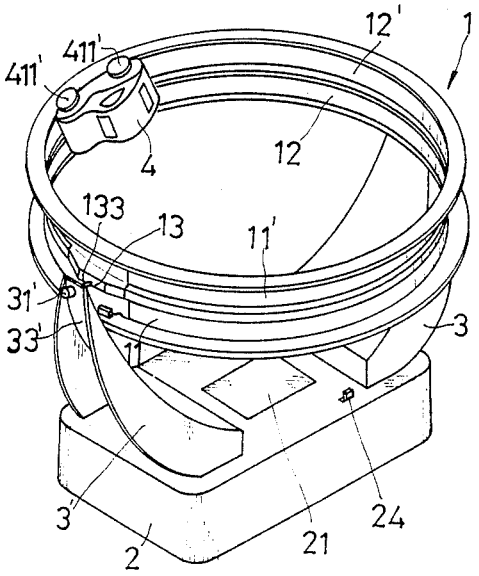
FIG. 8 illustrates a performance 3 of a preferred embodiment of the present invention wherein the wheeled toy car has moved forward relative to performance 2 and the ring structure has tilted substantially horizontal relative to the base.
Figure 6:
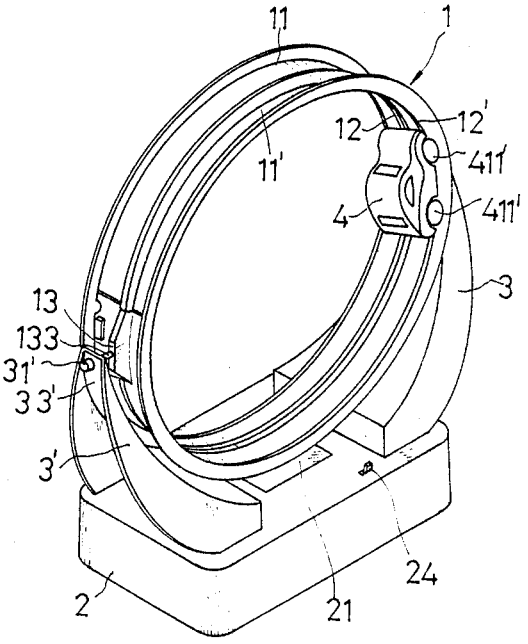
FIG. 6 illustrates performance 1 of a preferred embodiment of the invention wherein the wheeled toy car is placed in a start position on the ring structure.

The function of the whole structure, i.e. the performance of the present invention is as follows: Place a wheeled toy car 4 on the central position of the ring structure 1 (as shown in the FIG. 6) and turn on the switch 24. Then, the the metal wheels 42 and 42' make contact with the metal rings 12 and 12' to complete the electric circuit to motor 43. Motor 43 is then is activated for rotation and drives the metal wheels 42 and 42' for rotation and moving arount the ring structure 1. As there is a slight vibration on the ring structure 1 while the toy car is moving on it, the ring structure 1 is not perpendicular to the base 2, but in an angle $\theta$ to the perpendicular plane as shown in the FIG. 7. At this moment, the toy car 4 is at the higher position as indicated in the FIG. 7. Thus, the mass of the toy car constitutes a moment of force on the line between the supports 13. Such a moment of force constitutes a moment of inertia on the ring structure 1. According to the principle in physics, moment of force = mass × acceleration × distance × sin $\theta$. The moment of force can cause the ring structure 1 to continuously rotate. The moment of force reaches its maximum while the toy car 4 is in on the position as indicated in the FIG. 8, i.e., at 90°. At that position, the toy car 4 continues to move forward, the ring structure 1 continues to rotate due to the effect of moment of force. While the toy car 4 reaches the position as shown in the FIG. 9, the ring structure 1 is just at 180°, a perpendicular position. At this moment, due to a moment of inertia, the ring structure 1 keeps rotating and the toy car 4 continues moving about the circular ring 2 generating a moment of force in the same direction of the moment of inertia which can keep the ring structure 1 rotating in the same direction from 180° to 360°, just like that from 0° to 180°. Another cycle will begin when it reaches 360°, the starting position. The above process is a cycle of the toy car 4 moving around the ring structure 1 while a cycle of self-rotation of the ring structure is performed simultaneously, and refers to the start of toy car 4 while the ring structure is at 0° and the front part of the toy car 4 is placed upwards. Therefore, the toy car shall have a speed higher than a certain rate in order to keep a synchronous cycle. The speed of the toy car can be pre-set during manufacture or can be made adjustable by equipping the stunt toy device with a regulator. With a speed regulator, the faster the speed, the shorter the cycle and the faster the rotation which will provide a better visual effect. However, there is an upper limit for the period of a cycle. For irregular change, the toy car speed may be adjusted below its minimum or higher than its maximum, or change the start position for the toy car 4 on the ring structure 1. Then, though the toy car 4 will travel around the ring structure 1, the ring structure 1 will change the speed of its rotation suddenly or rotate at unstable vibration since the amount of force produced by the car body 4 may be in the reverse direction of the moment of inertia. The device can thus be considered as a funny toy because of the numerous performance variation.

The present invention is featured by the rotation of a ring structure 1 caused by the travelling of a toy car 4 around it which constitutes a moment of force on the shaft between its supports 13 to cause a moment of inertia. It is a device which applies the law of energy conversation in physics, the use of moment of force and moment of inertia. It is a combination of the simple oscillating toy and complicated multioscillating and expensive toy now available. It uses only a set of power source for rotation two sets of components.

Furthermore, the wheeled toy car can be replaced by any other type of toy car or any other object with built-in power source.

I claim:

1. A stunt toy device comprising:

a ring structure having two magnetized metal rings at its inner circumference and two supports at its external circumference;

two fixing blocks beneath said supports respectively to support the ring structure;

a base beneath the fixing blocks for holding the fixing blocks on its upper surface;

a wheeled toy car with a casing which can be placed across the ring structure, said car having a top and a bottom with conductive wheels for contacting said metal rings wherein each of said wheels is installed with a magnetic element for holding the wheel in contact with said ring structure, said car having a rotating motor which receives electrical power transmitted through said wheels; and an electric power source;

whereby when said wheeled toy car is placed on the inner circumference of said ring structure, said power source is then turned on and an electric circuit is formed including the base, said fixing blocks, said supports, said ring structure and said wheeled toy to drive said motor for rotation, said motor then drives said conductive wheels to move said wheeled toy around the inner circumference of said ring structure, said magnetic elements preventing said wheeled toy from falling down from said ring structure, the weight of said wheeled toy generating a moment of force causing said ring structure to rotate or oscillate between said supports.

2. A stunt toy device according to claim 1 wherein said electric power source is a battery.

3. A stunt toy device as claimed in the claim 1 wherein the two metal rings at the inner circumference of the ring structure are insulated from each other for contacting the conductive wheels of the wheeled toy at each side respectively.

* * * * *